US005907920A

United States Patent [19]

Laney

[11] Patent Number: 5,907,920

[45] Date of Patent: Jun. 1, 1999

[54] IGNITION ASSEMBLY FOR MUZZLE LOADING FIREARM

[75] Inventor: Mark C. Laney, Lee, N.H.

[73] Assignee: Thompson Intellectual Properties, Ltd., Rochester, N.H.

[21] Appl. No.: 08/960,490

[22] Filed: Oct. 29, 1997

[51] Int. Cl.[6] ..... F41A 17/00; F41C 7/00

[52] U.S. Cl. ..... 42/83; 42/51

[58] Field of Search ..... 42/83, 51

[56] References Cited

U.S. PATENT DOCUMENTS

| | | | |
|---|---|---|---|
| 4,163,335 | 8/1979 | Ives . | |
| 4,186,506 | 2/1980 | Pawiak et al. . | |
| 4,227,330 | 10/1980 | Chapin | 42/77 |
| 4,519,157 | 5/1985 | Giangerelli | 42/83 |
| 4,888,901 | 12/1989 | French et al. | 42/51 |
| 5,016,379 | 5/1991 | Lambert | 42/83 |
| 5,644,861 | 7/1997 | Knight | 42/51 |

*Primary Examiner*—Charles T. Jordan
*Assistant Examiner*—Chris J. Brown
*Attorney, Agent, or Firm*—Blodgett & Blodgett, P.C.

[57] ABSTRACT

An ignition assembly for a muzzle loading firearm. The ignition assembly includes a conventional breech plug and a modified percussion nipple having a rearward end for receiving a percussion cap and a forward end which extends into the nipple bore of the breech plug. The forward end of the nipple has a reduced diameter so that there is an annular space between the outer surface at the forward end of nipple and the inner surface which defines the nipple bore of the breech plug. The nipple has a rearward fire channel which extends forwardly from its rearward opening and a forward fire channel which extends from the forward end of the rearward fire channel to its forward opening at the powder well of the breech plug. A pair of side fire channels extend from the rearward fire channel to the annular space between the forward end of the nipple and an annular inner wall which defines the nipple bore of the breech plug to enable this annular space to function as an axillary fire channel leading to the powder well.

2 Claims, 4 Drawing Sheets

IGNITION ASSEMBLY FOR MUZZLE LOADING FIREARM

CROSS-REFERENCE TO RELATED APPLICATIONS

Not applicable

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention relates generally to muzzle loading firearms which utilize a percussion cap for igniting a power charge in the powder chamber of the firearm. The invention relates specifically to an ignition assembly for delivering a discharge of burning gas from the percussion cap to the powder charge. The ignition assembly includes a breech plug which is screwed into the breech of the firearm and a percussion nipple having a forward threaded end which is screwed into a threaded nipple bore of the breech plug. The nipple has a rearward end for snugly holding the percussion cap. The nipple has a large diameter rearward fire channel for receiving the discharge of burning gas from the percussion cap and a small diameter forward fire channel for receiving the discharge of burning gas from the rearward fire channel and directing the burning gas to the powder charge, thereby igniting the powder charge.

The misfiring of muzzle loading firearms which utilize a percussion cap and a percussion nipple has always been a problem that has been more or less accepted by users of such equipment. During recent years, this type of firearm has been used increasingly for hunting. There is no tolerance by a hunter for misfire of a firearm in a hunting situation.

The chance of a misfire is lessened considerably by using a more powerful or potent percussion cap. However, percussion nipples which are currently in use cannot handle a more potent or stronger discharge of burning gas from the percussion cap. Blowback of the discharge from the percussion cap is likely to occur. On the other hand, if the small diameter forward fire channel leading to the powder charge in the powder chamber is made larger, grains of powder from the powder chamber could spill back into the nipple. Also, this would cause a greater blowback from the powder chamber when the main powder charge of the firearm is ignited.

These and other difficulties experienced with the prior art ignition assemblies for muzzle loading firearms have been obviated by the present invention.

It is, therefore, a principal object of the present invention to provide an ignition assembly for muzzle loading firearms that reduce misfires without increasing blowback from either the ignition of the percussion cap or from the ignition of the main powder charge.

A further object of the invention is the provision of an ignition assembly for muzzle loading firearms that reduces misfires, while reducing blowback form the ignition of the main powder charge.

Another object of the invention is to provide a modified percussion nipple for a muzzle loading firearm which can be used with existing breech plugs which transforms the nipple/breech plug assembly into a modified nipple/breech plug assembly that reduces misfires and reduces blowback from discharge of the firearm.

A still further object of the invention is the provision of an ignition assembly for muzzle loading firearms that enables a more potent percussion cap to be used and reduces misfire without increasing blowback from discharge of the firearm.

With these and other objects in view, as will be apparent to those skilled in the art, the invention resides in the combination of parts set forth in the specification and covered by the claims appended hereto.

BRIEF SUMMARY OF THE INVENTION

The invention consists of an ignition assembly for a muzzleloading firearm. The ignition assembly includes a conventional breech plug and a modified percussion nipple having a rearward end for receiving a percussion cap and a forward end which extends into the nipple bore of the breech plug. The forward end of the nipple has a reduced diameter so that there is an annular space between the outer surface of the forward end of the nipple and the inner surface of which defines the nipple bore of the breech plug. The nipple has a rearward fire channel which extends forwardly from its rearward opening and a forward fire channel which extends from the forward end of the rearward fire channel to its forward opening at the powder well of the breech plug. A pair of opposed side fire channels extend laterally from the rearward fire channel to the annular space between the forward end of the nipple and an annular inner wall which defines the nipple bore of the breech plug to enable this annular space to function as an axillary fire channel leading to the powder well.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
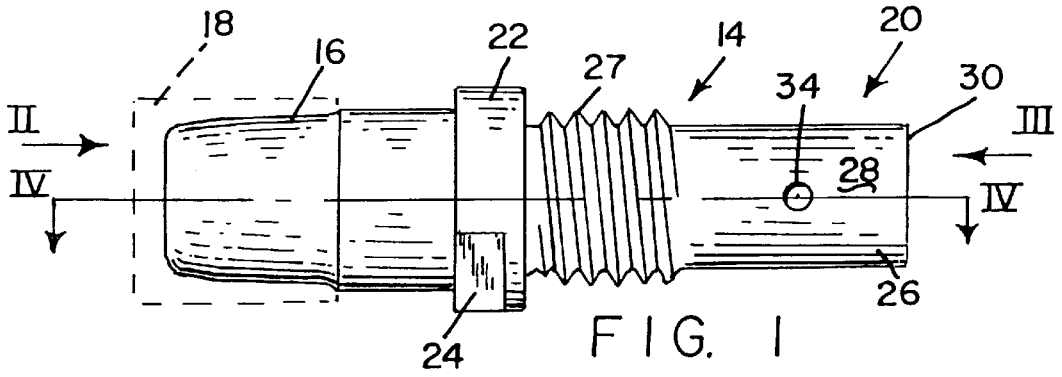
FIG. 1 is a side elevational view of a percussion nipple embodying the principles of the present invention.
Figure 2:
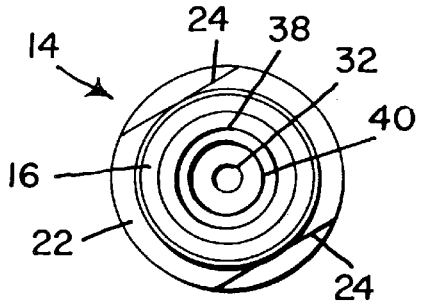
FIG. 2 is an end view of the nipple, looking in the direction of arrow II of FIG. 1.
Figure 3:
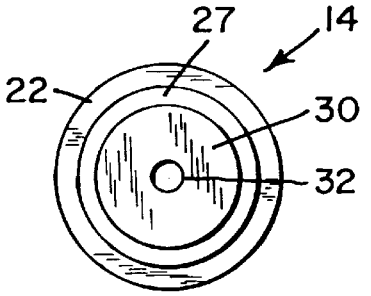
FIG. 3 is an end view of the nipple, looking in the direction of arrow III of FIG. 1.
Figure 4:
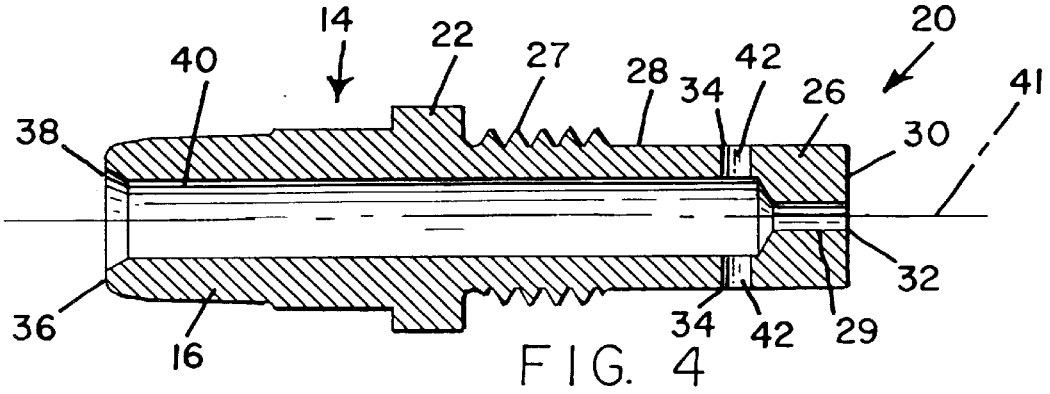
FIG. 4 is a horizontal cross-sectional of the nipple, taken along the lines IV—IV of FIG. 1 and looking in the direction of the arrows.

Referring first to FIGS. 1–4, the percussion nipple of the present invention is generally indicated by the reference numeral 14. Percussion nipple 14 has a forward end, generally indicated by the reference numeral 20, a rearward end 16 for receiving a percussion cap 18, shown in dotted lines, and a fixture 22 located between the rearward end 16 and the forward end 20. The fixture 22 has a pair of opposed flat areas 24 for receiving a wrench for tightening the nipple when it is inserted into a breech plug.

The forward end 20 includes an elongated free end portion 26 and a threaded portion 27 that has external threads for enabling the nipple to be screwed into the nipple bore of a breech plug. The elongated free end portion 26 has a cylindrical outer surface 28 and a forward end surface 30. The outer surface 28 has a pair of opposed side openings 34. The forward end surface 30 has a forward opening 32 which opens to a forward fire channel 29. The rearward end 16 has a rearward end surface 36 which has a rearward end opening 38. The nipple 14 contains a rearward fire channel 40 which extends from a rearward opening 38 to the forward fire channel 29. The forward end 20 of the nipple has a pair of opposed side fire channels 42 which extend transversely from the rearward fire channel 40 to the side openings 34. The fire channels 40 and 29 are coaxial with the central longitudinal axis 41 of the nipple.

Figure 5:
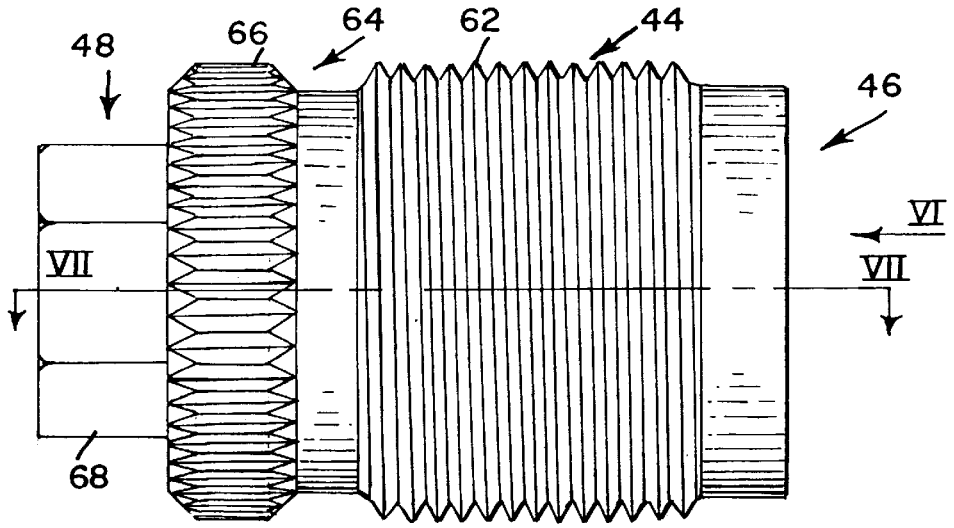
FIG. 5 is side elevational view of a breech plug which forms part of the ignition assembly of the present invention.
Figure 6:
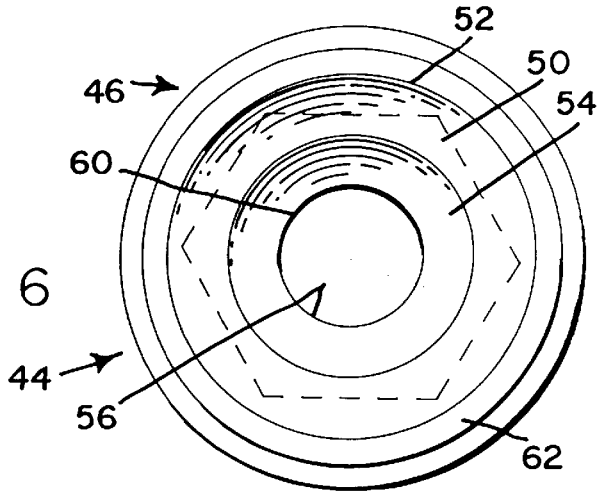
FIG. 6 is an end view of a breech plug, looking in the direction of arrow VI of FIG. 5.
Figure 7:
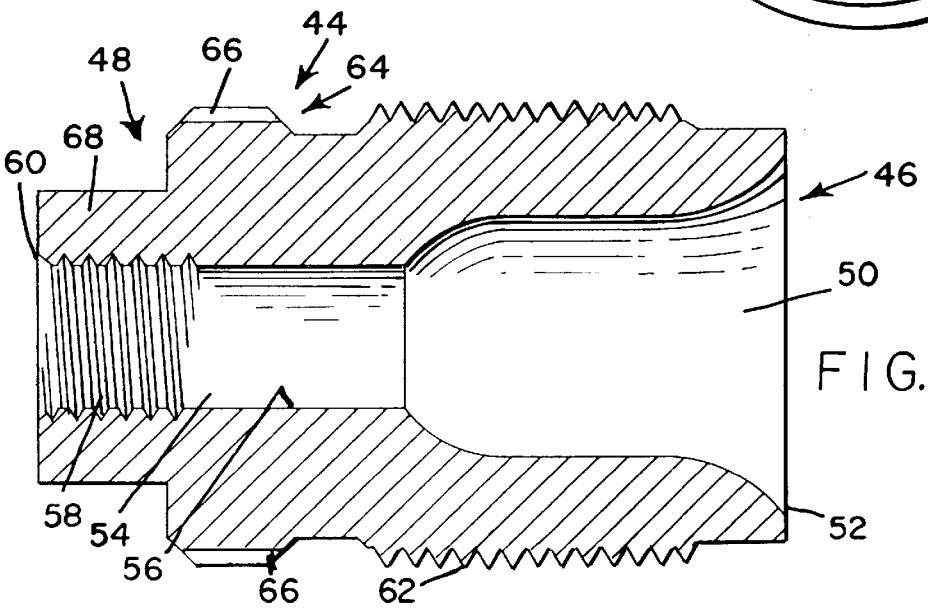
FIG. 7 is a horizontal cross-sectional view of a breech plug, taken along the lines of VII—VII of FIG. 5 and looking in the direction of the arrows.

Referring to FIGS. 5–7, a breech plug, generally indicated by the reference numeral 44, has a forward end, generally indicated by the reference numeral 46, and a rearward end, generally indicated by the reference numeral 48. The forward end 46 contains a powder well 50 which extends from the center of the plug to a forward opening 52. When the breech plug 44 is screwed into the breech of a muzzleloading firearm, the forward opening 52 enables the powder well 50 to be contiguous with the powder chamber at the breech of the firearm. The breech plug 44 contains a nipple bore 54 which is defined by an inner cylindrical surface 56. The rearward half of the cylindrical surface 56 contains internal threads 58. The nipple bore 54 extends from the rearward opening 60 to the powder well 50. The outer side surface of the breech plug 44 has external threads 62 which mate with corresponding internal threads in an opening in the breech of the firearm. The rearward end of the breech plug has a fixture 64 for enabling the breech plug to be inserted into the breech of the firearm. The fixture 64 includes a hexagonal surface 68 for receiving a wrench and a knurled annular surface 66 for removing the plug by hand after it has been loosened with a wrench or inserting the plug by hand and tightening the plug with a wrench.

Figure 8:
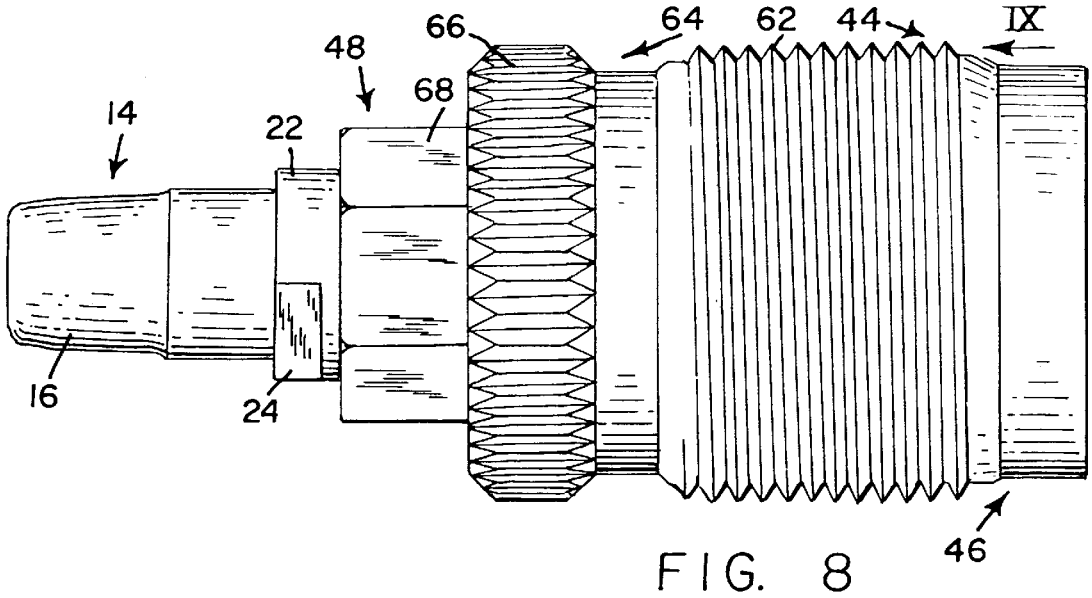
FIG. 8 is a side-elevational view of an ignition assembly comprising the nipple of FIG. 1 and the breech plug of FIG. 5.
Figure 9:
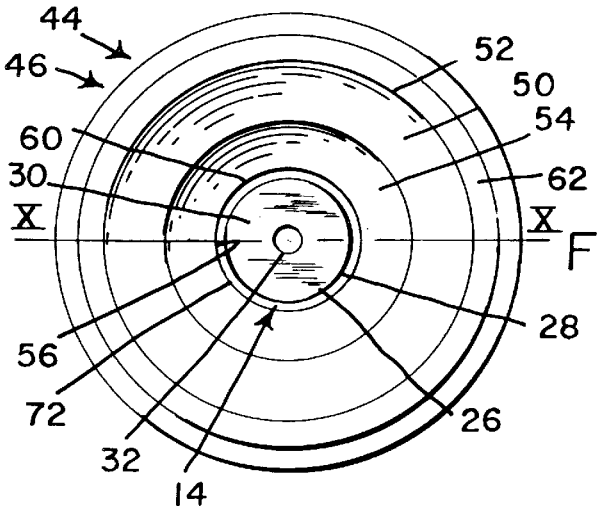
FIG. 9 is an end view of the ignition assembly, looking in the direction of arrow IX of FIG. 8.
Figure 10:
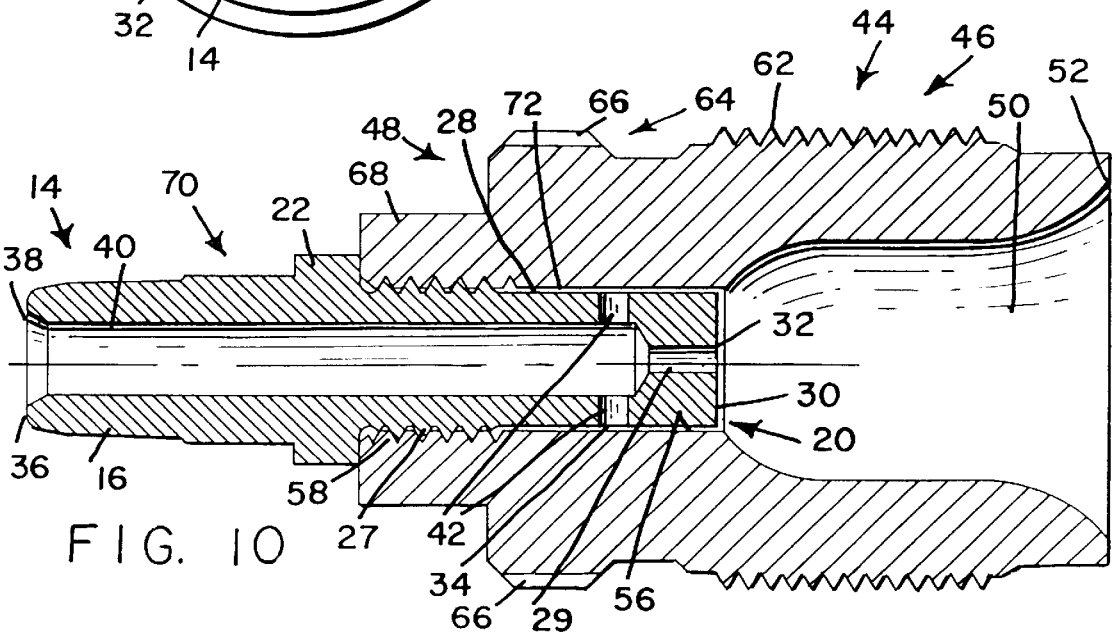
FIG. 10 is a horizontal cross-sectional view of the ignition assembly, taken along the lines of X—X of FIG. 9 and looking in the direction of the arrows.

Referring to FIGS. 8–10, the ignition assembly of the present invention, generally indicated by the reference numeral 70, includes the nipple 14 and the breech plug 44. The ignition assembly 70 is assembled by screwing the forward end 20 of the nipple 14 into the nipple bore 54. The elongated free end portion 26 of the nipple is located within the nipple bore 54 and extends to the rearward end of the powder well 50 as shown in FIG. 10. The outer diameter of the free end portion 26 is substantially less than the inner diameter of the nipple bore 54 so that the outer surface 28 of the nipple is spaced from the inner surface 56 of the nipple bore to form an annular auxiliary fire channel 72 extending from the side fire channels 42 to the powder well 50.

With the ignition assembly of the present invention operatively connected to the breech of a muzzleloading firearm, a loaded firearm is discharged by attaching a percussion nipple 18 to the rearward end 16 of the nipple. When the hammer of the firearm is released, it strikes the percussion cap, thereby discharging same, and causing a discharge of burning gas to enter the rearward fire channel 40. The burning gas from the rearward fire channel 40 enters the side fire channels 42 and the forward fire channel 29. Powder within the powder well 50 and in the powder chamber of the firearm is ignited by a stream of burning gas from the central forward fire channel 29 and an annular stream of burning gas from the auxiliary fire channel 72. The auxiliary fire channel 72 enables a more potent percussion cap to be used without causing any additional blowback of burning gas from the percussion cap and without increasing the diameter of the forward fire channel 29. The fire channels 29 and 72, create a double wave front of burning gas which is considerably larger in cross section than that which is produced by prior art percussion nipples. Also, the wave front of burning gas is spread out over a wider area to produce a quicker and more uniformed ignition of the powder within the powder well 50 and in the breech of the rifle. In addition, the blowback from ignition of the main powder charge is reduced. The amount of rearward blowback from the forward fire channel 29 is approximately the same as for prior art percussion nipples. However, blowback from the auxiliary fire channel 72 is directed transversely to the blowback from the forward fire channel 29, thereby causing turbulence at the point of intersection of the side channels 42 and the forward fire channel 40 and reducing the amount of blowback exiting the rearward end opening 38 from the rearward fire channel 40.

MODIFIED IGNITION ASSEMBLY

Figure 11:
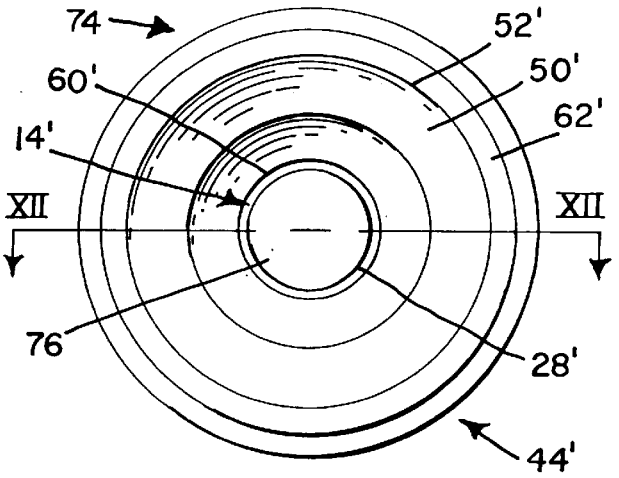
FIG. 11 is an end view of a modified ignition assembly.
Figure 12:
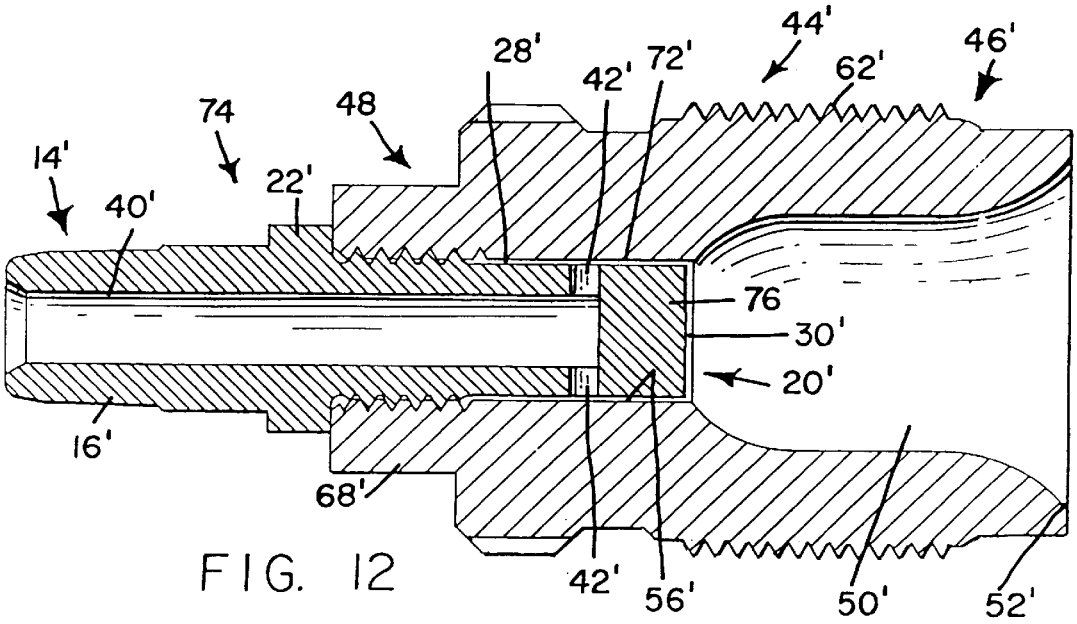
FIG. 12 is a horizontal cross-sectional view of the modified ignition assembly, taken along the line XII—XII of FIG. 11 and looking in the direction of the arrows.

Referring to FIGS. 11 and 12, there is shown a modified ignition assembly, generally indicated by the reference numeral 74. The ignition assembly 74 includes the previously described breech plug 46 and a modified nipple, generally indicated by the reference numeral 14'. Nipple 14' is identical to nipple 14 except that the free end portion of the nipple identified by the reference numeral 76, does not have a forward fire channel or a forward end opening. All portions of the modified nipple 14' which are the same as nipple 14 are identified with the same reference numerals with the addition of a'. In addition, the cross-sectional area of the auxiliary fire channel 72' is greater than the cross-sectional area of the auxiliary fire channel 72 to compensate for the absence of a forward fire channel 29. The cross-sectional area of the auxiliary fire channel 72 can vary in accordance with the potency of the percussion cap.

What is claimed is:

1. An ignition assembly for a muzzle loading firearm having a breech containing a powder chamber, said ignition assembly comprising:

(a) a breech plug for mounting to said breech, said breech plug having a forward end containing a powder well and a rearward end containing a nipple bore which is defined by an inner surface, said breech plug having a forward opening to said powder chamber at said forward end for enabling said powder well to be contiguous with said powder chamber when said beech plug is mounted to said breech and a rearward opening to said nipple bore at said rearward end, said nipple bore extending from said rearward opening to said powder well; and (b) a nipple having a rearward end for receiving a percussion cap and a forward end connected to said breech plug and extending into said nipple bore, said nipple having a rearward fire channel, a forward fire channel at the forward end of said nipple extending from said rearward fire channel to said powder well for conducting a first stream of burning gas from a percussion cap at said nipple to the powder in said powder well, a rearward opening at the rearward end of said nipple to said rearward fire channel for receiving an explosive discharge from a percussion cap, at least one side fire channel spaced rearwardly from said powder well and extending laterally from said rearward fire channel to said nipple bore, a portion of the forward end of said nipple within said nipple bore being spaced from the inner surface of said breech plug to define with said inner surface an auxiliary fire channel extending longitudinally from said side fire channel to said powder well for conducting a stream of burning gas from a percussion cap at the nipple to the powder in said powder well, said forward fire channel being substantially smaller in cross-sectional area than said rearward fire channel.

2. An ignition assembly for a muzzle loading firearm having a breech containing a powder chamber, said ignition assembly comprising:

(a) a breech plug for mounting to said breech, said breech plug having a forward end containing a powder well and a rearward end containing a nipple bore which is defined by an inner surface, said breech plug having a forward opening to said powder chamber at said forward end for enabling said powder well to be contiguous with said powder chamber when said breech plug is mounted to said breech and a rearward opening to said nipple bore at said rearward end, said nipple bore extending from said rearward opening to said powder well; and (b) a nipple having a central longitudinal axis, rearward end for receiving a percussion cap and a forward end connected to said breech plug and extending into said nipple bore, said nipple having a rearward fire channel extending along said central longitudinal axis, a forward fire channel at the forward end of sad nipple extending along said central longitudinal axis from said rearward fire channel to said powder well, a rearward opening at the rearward end of said nipple to said rearward fire channel for receiving an explosive discharge from a percussion cap, at least one side fire channel spaced rearwardly from said powder well and extending laterally from said rearward fire channel to said nipple bore, a portion of the forward end of said nipple within said nipple bore being spaced from the inner surface of said breech plug to define with said inner surface an auxiliary fire channel extending from said side fire channel to said powder well, said forward fire channel being substantially smaller in cross-sectional area than said rearward fire channel, said auxiliary fire channel being annular and co-axial with said central longitudinal axis.

* * * * *